United States Patent [19]

Bertram et al.

[11] Patent Number: 4,637,283

[45] Date of Patent: Jan. 20, 1987

[54] CORKSCREW DEVICE

[75] Inventors: Leo Bertram, Stolberg, Fed. Rep. of Germany; Romuald L. Bukoschek; Peter Steiner, both of Klagenfurt, Austria

[73] Assignee: U.S. Philips Corporation, New York, N.Y.

[21] Appl. No.: 738,131

[22] Filed: May 24, 1985

[30] Foreign Application Priority Data

Jun. 1, 1984 [AT] Austria ..... 1808/84

[51] Int. Cl.[4] ..... B67B 7/04

[52] U.S. Cl. ..... 81/3.2; 81/3.29

[58] Field of Search ..... 81/3.2, 3.36, 3.37, 81/3.29, 3.48; 310/41; 318/136, 280, 778, 466–468

[56] References Cited

U.S. PATENT DOCUMENTS

| | | | |
|---|---|---|---|
| 1,938,484 | 12/1933 | Clarin | 81/3.2 |
| 1,988,971 | 1/1935 | Maynz et al. | 81/3.2 |
| 2,004,211 | 6/1935 | Manzinger | 81/3.2 |
| 3,073,176 | 1/1963 | Dangirdas | 310/41 X |
| 3,179,216 | 4/1965 | Tetro | 310/41 X |
| 3,473,058 | 10/1969 | Landgraf et al. | 310/41 |
| 3,614,492 | 10/1971 | Yatsushiro | 310/41 |
| 3,748,508 | 7/1973 | Woolley | 310/41 |
| 3,842,296 | 10/1974 | Gerber | 310/41 |

FOREIGN PATENT DOCUMENTS

| | | | |
|---|---|---|---|
| 209365 | 5/1909 | Fed. Rep. of Germany | 81/3.2 |
| 1230326 | 11/1964 | Fed. Rep. of Germany | 81/3.2 |
| 3037785 | 5/1982 | Fed. Rep. of Germany . | |

*Primary Examiner*—Frederick R. Schmidt
*Assistant Examiner*—Debra S. Meislin
*Attorney, Agent, or Firm*—Rolf E. Schneider

[57] ABSTRACT

A corkscrew comprises a sleeve coaxial with a corkscrew spiral and formed to cooperate with a bottleneck provided with a cork. An electric motor drives the corkscrew spiral by means of a reduction gear, the corkscrew spiral being capable of being screwed into the cork in one direction of rotation with the cork being drawn from the bottleneck without the direction of rotation being reversed, the reduction gear providing a reduction ratio of 60:1 to 100:1, the electric motor being a self-starting two-pole single-phase synchronous motor with a diametrically magnetized permanent-magnet rotor. A reversible unidirectional latch is situated at the driven side of the corkscrew spiral for defining the direction of rotation of the motor, such unidirectional latch cooperating with a part of the reduction gear driven by the motor with an integral reduction ratio. Provision is made to reverse the blocking direction of the unidirectional latch to select one of the two directions of rotation of the motor.

16 Claims, 2 Drawing Figures

CORKSCREW DEVICE

This invention relates to a corkscrew device comprising a sleeve which is coaxial with a corkscrew spiral and which is adapted to cooperate with a bottleneck, and an electric motor which drives the corkscrew spiral via a reduction gear, which corkscrew spiral can be screwed into a cork in one direction of rotation and draws said cork from a bottleneck without the direction of rotation of the drive being reversed. Such a corkscrew device is disclosed in published German application OS 3,037,785, which device comprises a d.c. motor powered by batteries or rechargeable accumulator batteries. Since for removing a cork from a bottle a comparatively high power may be required, the batteries which power the electric motor are drained to a comparatively large extent and have to be replaced or recharged frequently, which renders the use of such a corkscrew device rather expensive and problematic. Moreover, corkscrew devices should be easy to handle, which means that their dimensions should be as small as possible.

It is the object of the present invention to provide a corkscrew device which has minimal dimensions and a powerful drive and which requires no further maintenance. According to the invention a corkscrew device of the indicated type is characterized in that the electric motor is a self-starting two-pole single-phase synchronous motor with a diametrically magnetized permanent-magnet rotor whose direction of rotation for screwing the corkscrew spiral into a cork is defined by a unidirectional latch at the driven side and the reduction gear is adapted to provide a reduction ratio in the range from 60:1 to 100:1. These features result in a compact construction and a powerful drive for the corkscrew spiral because single-phase synchronous motors can produce a comparatively high power, even if they have small dimensions, the selected reduction ratio of the reduction gear converting said power into the force necessary for a correct removal of a cork from a bottleneck. A similar reduction in size cannot be achieved with mains-powered a.c. motors having the same power rating but operating on other principles, such as for example induction motors.

For the unidirectional latch which defines the desired direction of rotation of the single-phase synchronous motor various constructions are known. For example, the unidirectional latch may cooperate directly with the motor shaft and may be constructed to form a unit with the motor. It is found to be very advantageous if the unidirectional latch cooperates with a part of the reduction gear which is driven by the motor with an integral reduction ratio. As the unidirectional latch cooperates with a part of the reduction gear, a reliable unidirectional latch of simple construction can be obtained, its cooperation with a part of the reduction gear which is driven by the motor with an integral reduction ratio ensuring in a simple manner that the single-phase synchronous motor always starts from the same predetermined position, which is essential because reliable starting of a single-phase synchronous motor is guaranteed only under the starting conditions for which it has been designed.

In the known corkscrew device of the specified type the cork which has been drawn from a bottle must be twisted off the corkscrew spiral by hand. In this respect the use of a single-phase synchronous motor has a further advantage if the blocking direction of the unidirectional latch can be reversed to select one of the two directions of rotation of the motor. After removal of a cork the unidirectional latch can now be switched over to reverse the direction of rotation of the corkscrew spiral, so that the cork is automatically twisted off the corkscrew spiral when the cork is held, which greatly simplifies the operation of the corkscrew device.

To obtain a very simple and compact construction it is found to be advantageous if a reversible unidirectional latch is constructed by providing a radial surface of said part of the reduction gear with two radially spaced concentric curved tracks which each comprise a projecting stop portion, the stop portion in one track being operative in one direction of rotation and the stop portion in the other track being operative in the other direction of rotation, and by providing a spring-loaded pivotal arm which carries a projection which extends between the two tracks, which cooperates slidably with one of the two tracks, and which can be made to cooperate slidably with the other track by pivoting the arm by means of an actuating member.

To simplify the construction it is also found to be advantageous if the spring load for the arm is provided by a leafspring arranged adjacent the arm, one end of the spring being connected to the arm near the pivotal axis of the arm and the other end of the spring bearing against a stationary part of the corkscrew device, and the actuating member is constructed as a slide which is movable between a rest position and an operating position, a free end of said slide facing that end of the leafspring which bears against the stationary part of the corkscrew device when the slide is in it rest position and, when the slide is set to its operating position, said free end being pressed against the end of the leafspring, thereby causing the arm to be pivoted.

For the manufacture of the device it is found to be particularly simple if the arm and the leafspring are constructed as an integral plastic part.

It is found to be very advantageous if the arm is axially deflectable to a limited extent. This ensures that the reduction gear is not subjected to excessive shocks when the unidirectional latch becomes operative.

There are various possibilities of constructing the arm so that it is axially deflectable to a limited extent. A very simple and reliable construction is obtained if the arm comprises an oval strip formed into the shape of an eight. Suitably, an arm of this shape can be manufactured as a plastic part.

In order to minimize the power consumption of the single-phase synchrnous motor the manner in which the corkscrew spiral is driven is very important. In this respect it is found to be very advantageous if the reduction gear drives a lead screw which is connected to the corkscrew can spiral and whose pitch is directed oppositely to the pitch of the corkscrew spiral, which lead-screw cooperates with a lead-screw nut near the reduction gear, the sleeve which is adapted to cooperate with a bottleneck being arranged on said lead-screw near the corkscrew spiral so as to be retained and to be slidable freely and the facing sides of the lead-screw nut and the sleeve being provided with abutment surfaces which cooperate with each other during removal of a cork from a bottle when the lead-screw can nut moves along the lead-screw. In this way the corkscrew be driven with minimal power by means of a simple construction, which guarantees reliable operation of the corkscrew device.

In this respect it is found to be advantageous if one of the two abutment surfaces is provided with a friction coating. As a result, the friction between the sleeve and the lead-screw nut, which causes the nut to move along the lead-screw, increases, thereby ensuring a reliable cooperation of the sleeve with the lead-screw nut and hence correct removal of a cork from a bottle.

In this respect it is also found to be advantageous if one of the two abutment surfaces is profiled. This further improves the cooperation of the sleeve with the lead-screw nut. Various profiles may be selected, for example ribbed wafer-like profiles.

In this respect it is also found to be advantageous if the two abutment surfaces are conical surfaces whose angle of inclination relative to the axis of the corkscrew spiral is of the order of magnitude of 60°. This also ensures a reliable cooperation of the sleeve with the lead-screw nut.

In this respect it is also found to be advantageous if the sleeve which is adapted to cooperate with the bottleneck is provided with an elastomeric ring. The resulting increase in friction between the sleeve and the bottleneck ensures that the sleeve and hence the lead-screw nut cannot rotate.

Further it is found to be advantageous if the lead-screw has at least two turns and has pitch between 6 mm and 10 mm. This ensures that the movement of the nut along the lead-screw proceeds correctly and requires minimal power.

It is also found to be advantageous if a helical spring which is coaxial with the lead-screw urges the lead-screw nut towards a stop which is located at that end of the lead-screw which is situated near the reduction gear. Thus, after removal of a cork from a bottle, the lead-screw nut returns to its initial position under the influence of the helical spring.

It is also advantageous if a helical spring which is arranged between the sleeve and the lead-screw nut and which is coaxial with the lead-screw urges the sleeve towards the corkscrew spiral. This ensures that the sleeve has a well-defined initial position in which it covers the cork-screw, thereby precluding the risk of injury.

In this respect it is also found to be advantageous if the sleeve is made of a transparent material. Since the sleeve covers the corkscrew spiral in the initial position the use of a transparent sleeve makes it easier to centre the tip of the corkscrew spiral on a cork and also enables the removal of a cork from a bottle to be observed.

For a further reduction of the power of the single-phase synchronous motor it is found to be advantageous if a disengageable coupling is arranged between the corkscrew spiral and the lead-screw to transmit the rotation of the lead-screw to the corkscrew spiral, which coupling is disengaged automatically upon removal of a cork from a bottle. Thus, since the corkscrew spiral no longer rotates when a cork is being drawn from a bottle, the cork is not rotated inside the bottleneck, which would require a substantial amount of power, which is thus saved.

For such a coupling various known constructions may be used. For a simple construction of a coupling which does not consume any power it is found to be very advantageous if the corkscrew spiral is provided with a cylindrical shank which fits an axial bore in the lead-screw and which is urged away from the corkscrew spiral by a helical spring arranged in the bore, a transverse pin arranged on the shank being urged into a transverse groove of trapezoidal cross-section formed in the end surface of the lead-screw under the influence of the helical spring to couple the corkscrew spiral to the lead-screw when the corkscrew spiral is screwed into a cork and being disengaged from said groove against the action of the helical spring to uncouple the corkscrew spiral from the lead-screw during removal of the cork from the bottleneck.

The invention will now be described in more detail with reference to the accompanying drawings, in which.

Figure 1:
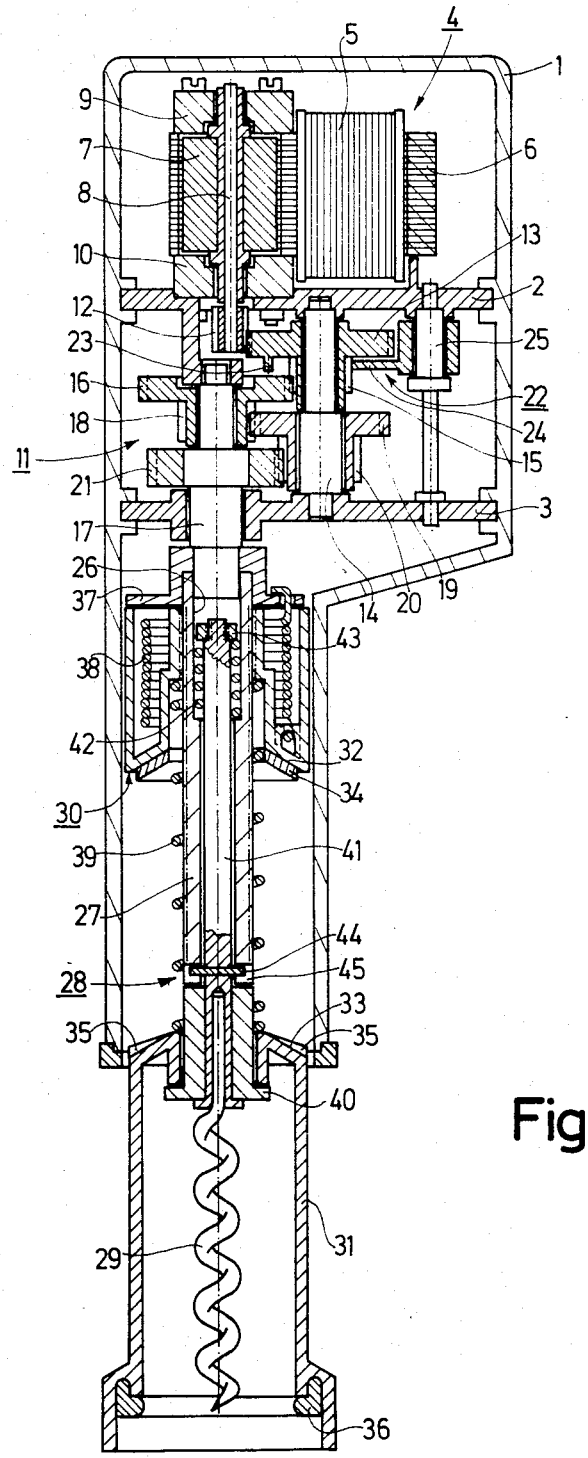
FIG. 1 is a longitudinal sectional view of a corkscrew device whose corkscrew spiral is driven by a single-phase synchronous motor via a reduction gear.

In the corkscrew device shown in FIG. 1 two mounting plates 2 and 3 are spaced from each other inside the housing 1. One side of the mounting plate 2 carries a self-starting two-pole single-phase synchronous motor 4 which in the customary manner comprises a U-shaped stator 6 provided with an exciter coil 5 and a cylindrical rotor 7. This diametrically magnetized rotor 7 is made of a permanent magnet material and is arranged between the end portions of the two limbs of the stator 6, which end portions constitute polepieces, for which purpose the motor shaft 8, which is connected to the rotor, is journalled in two bearing plates 9 and 10, the free end of the motor shaft 8 extending through a hole in the mounting plate 2. Such a single-phase synchronous motor of comparatively small dimensions is capable of delivering a comparatively high power, so that it is very suitable for driving a corkscrew.

A reduction gear 11, which in the present case is constructed as a four-stage gearbox, is arranged between the two mounting plates 2 and 3. This gearbox comprises a first pinion 12 which is mounted on the free end of the motor shaft and which cooperates with a first gear wheel 13 which is journalled on a shaft 14 arranged between the two mounting plates 2 and 3 and which is connected to a second pinion 15. This second pinion 15 cooperates with a second gear wheel 16 which is journalled on a second shaft 17 which in its turn is mounted for rotation in the mounting plates 2 and 3, which second gear wheel is connected to a third pinion 18. This third pinion 18 cooperates with a third gear wheel 19 which is journalled on the shaft 14 and which is connected to a fourth pinion 20 which cooperates with a fourth gear wheel 21 which is fixed to the shaft 17. In this way the single-phase synchronous motor 4 drives the shaft 17 with a reduction ratio determined by the reduction gear 11. It is obvious that the reduction gear may be constructed differently, for example as a planetary gearbox or as a combination of different gear mechanisms.

Since a single-phase synchronous motor starts in a random direction of rotation, a unidirectional latch 22, which ensures that the motor rotates in only one of the two directions, is arranged at the driven side. Such unidirectional latches are known in many different versions and may for example cooperate directly with the motor shaft. In the present example the unidirectional latch cooperates with a part of the reduction gear 11, namely with the first gear wheel 13 which for this purpose comprises a projection 23. The unidirectional latch itself comprises an arm 24 which is pivotally mounted on a fixed shaft 25 arranged between the mounting plates 2 and 3 and which is urged against a stop by means of a spring. The spring and the stop are not shown in the drawing. In the desired direction of rotation the arm 24 is lifted off the stop against the action of the spring by the projection 23 on the gear wheel 13, so that the projection 23 moves past the arm 24, and in the other direction of rotation the projection 23 abuts with the arm 24 and urges this arm against the stop, so that the projection 23 cannot move past the arm 24 and thus precludes a further movement in this direction of rotation, as a result of which the single-phase synchronous motor automatically reverses to start the desired direction of rotation. The reduction ratio obtained between the pinion 12 and the gear wheel 13 is an integral ratio, for example 5:1, which ensures that the unidirectional latch 22 always causes the rotor 7 to stop in the same position relative to the stator, which position has been so selected that starting is guaranteed, which is generally achieved by a suitable construction of the stator polepieces which surround the rotor. In this way it is ensured that the singlephase synchronous motor is always started in the desired direction of rotation.

A lead-screw 27 formed with an axial bore 26 is rigidly connected to the shaft 17, which lead-screw is connected to a corkscrew spiral 29 via a disengageable coupling 28. The pitch of the lead-screw is directed oppositely to the pitch of the corkscrew spiral. In order to convert the power delivered by the single-phase synchronous motor 4 into a force which ensures correct removal of a cork from a bottle, for which the lead-screw 27 must be driven with such a speed that the corkscrew spiral 29 is screwed correctly into a cork and the cork is also drawn correctly from the bottleneck, the reduction gear 11 is given a reduction ratio in the range from 60:1 to 100:1, for example 70:1, in which case a motor power of approximately 10 W is adequate, enabling a single-phase synchronous motor of comparatively small dimensions to be used.

Near the reduction gear 11 a lead-screw nut 30 is fitted on the lead-screw 27 and near the corkscrew spiral 29 a sleeve 31, which is adapted to cooperate with a bottleneck, is arranged on the lead-screw or an extension thereof in such a way that it cannot become detached and is freely slidable. The facing sides of lead-screw nut 30 and the sleeve 31 are formed with abutment surfaces 32 and 33, respectively, the abutment surface 32 of the lead-screw nut 30 being provided with a friction coating 34 and the abutment surface 33 on the sleeve 31 being profiled for which purpose it comprises a plurality of wedge-shaped radial ribs 35. Further, the two abutment surfaces 32 and 33 are conical with an angle of inclination of approximately 60° relative to the corkscrew axis. For its cooperation with a bottleneck the sleeve 31 is provided with an elastomeric ring 36 at its open end. In order to guarantee a satisfactory power transmission between the lead-screw 27 and the lead-screw nut 30 the lead-screw suitably comprises a plurality of turns, for example three, with a pitch in the range from 6 mm to 10 mm, for example 9 mm. The corkscrew spiral 29 is found to be effective if the pitch is approximately 10 mm when the helix diameter is approximately 8 mm.

Near the end of the lead-screw 27 adjacent the reduction gear 11 there is provided a stop 37 constituted by a disc with a hub-like portion with which it is mounted on the lead-screw 27 or the shaft 17. Further, one end of a helical spring 38 which is coaxial with the lead-screw 27 is connected to the stop 37 and the other end to the lead-screw nut 30, thus urging the lead-screw nut 30 towards the stop 37. A further helical spring 39 which is also arranged between the lead-screw nut 30 and the sleeve 31 and which is coaxial with the lead-screw 27, urges the sleeve 31 towards the corkscrew spiral 29, i.e. towards a flange 40 connected to the corkscrew spiral 29. In this way the spring 38 defines an initial position for the lead-screw nut 30 and the spring 39 defines an initial position for the sleeve 31, the sleeve 31 covering the corkscrew spiral 29 in its initial position. Suitably, the sleeve is made of a transparent material, so that the corkscrew spiral 29 is visible, but this can also be achieved by means of cut-outs.

In order to form the disengageable coupling 28 the corkscrew spiral 29 is provided with a cylindrical shank 41 which fits the axial bore 26 in the lead-screw 27. Further, a helical spring 42 is arranged in the bore 26 of the lead-screw 27, one end of the spring acting against a shoulder in the bore 26 of the lead-screw 27 and the other end acting against a nut 43 on the end portion of the shank 41, so that the helical spring 42 urges the shank 41 away from the corkscrew spiral 29. Further, a transverse pin 44 is fitted into the shank 41 and engages a transverse groove 45 having a trapezoidal cross section in the end portion of the lead-screw 27 under the influence of the spring 42 to couple the lead-screw 27 and the corkscrew spiral 29 to each other, so that a rotation of the lead-screw 27 is imparted to the corkscrew spiral 29. If the corkscrew spiral 29 is subjected to a force which is directed towards its free end, the pin 44 is disengaged from the groove 45 in the lead-screw 27 against the action of the spring 42, so that the coupling is disengaged automatically and rotation of the lead-screw 27 is no longer transmitted to the corkscrew spiral 29. If this force ceases, the helical spring 42 again urges the pin 44 into the groove 45, so that the coupling is restored. As a result of the trapezoidal cross-section of the groove 45 the pin 44 can readily engage the groove 45.

The corkscrew device operates as follows. The tip of the corkscrew spiral 29 is centred on a cork, the ring on the sleeve 31 bearing on the top of the bottleneck. Subsequently, the single-phase synchronous motor 4 is switched on, so that the lead-screw 27 begins to rotate and its rotation is transmitted to the pin 44 via the groove 45 and hence to the corkscrew spiral 29, which is then screwed into the cork. The latch 22 then defines such a direction of rotation for the single-phase synchronous motor 4 that the corkscrew spiral is screwed in. As the corkscrew spiral 29 is screwed into the cork the sleeve 31 is moved towards the lead-screw nut 30 against the action of the spring 39 until the ribs 35 on its abutment surface 33 cooperate with the friction coating 34 on the abutment surface 32 of the lead-screw nut 30, so that the lead-screw nut 30 is retained by the sleeve 31 and the sleeve 31 in its turn cannot rotate because it cooperates with the bottleneck via the elastomeric ring 36. Since the lead-screw nut 30 is retained and the rotation of the lead-screw 27 continues, a force is built up, which is directed away from the corkscrew spiral 29, so that the corkscrew spiral 29 pulls at the cork. The pin 44 is now disengaged from the groove 45 against the action of the spring 42 by the counter-force produced by the cork in the bottleneck, so that the coupling 28 is disengaged and rotation is no longer imparted to the corkscrew spiral 29. As the force which is directed away from the corkscrew spiral increases the lead-screw nut 30 is moved along the lead-screw 27 towards the corkscrew 29 against the action of the helical spring 38, causing the cork to be pulled up until it is completely drawn out of the bottle, so that the force is interrupted. Under the influence of the helical spring 38 which has been expanded because the lead-screw nut 30 moves along the lead-screw 26 and which has also been wound as a result of the rotation of the stop 37, the lead-screw nut 30 is returned to its initial position along the lead-screw 27. Further, the spring 42 ensures that the pin 44 again engages the groove 45 in the lead-screw 27, so that the coupling 28 is restored. After this, the cork can be twisted off the corkscrew spiral 29 by hand.

It will be appreciated that for correct removal of a cork from a bottle it is important that during this operation the lead-screw nut 30 is retained correctly by the sleeve 31, to ensure that the force required for removing the cork is built-up correctly. In the present embodiment this is achieved by the shape of the abutment surfaces 32 and 33 on the lead-screw nut 30 and the sleeve 31 respectively, by the friction coating 34 on the surface 32, by the ribs 35 formed on the surface 33 and by the elastomeric ring 36 on the sleeve 31. The disengageable coupling 28 between the lead-screw 27 and the corkscrew spiral 29 is also important because during the removal of a cork from a bottle the disengagement of the coupling ensures that rotation of the corkscrew spiral 29 does not continue so that the cork is not rotated inside the bottleneck, which saves a substantial amount of power and is therefore important in respect of the dimensioning of the single-phase synchronous motor.

Figure 2:
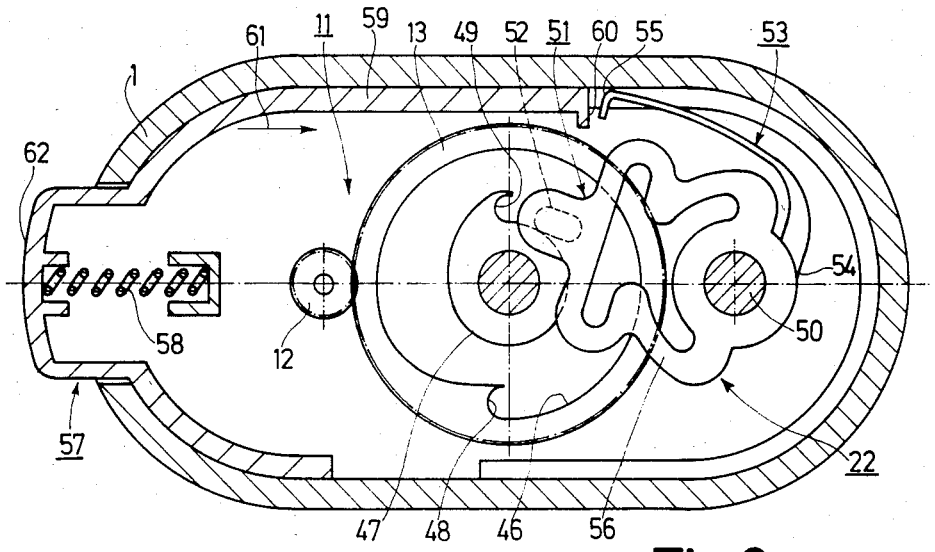
FIG. 2 is a sectional view of a unidirectional latch whose blocking direction is reversible and which cooperates with a reduction gear as used in the corkscrew device shown in FIG. 1.

The removal of a cork from the corkscrew spiral can also be effected automatically if the corkscrew spiral can also be driven in a direction of rotation opposite to that during screwing-in, so that the cork merely has to be retained by hand to be twisted off the corkscrew spiral. In a corkscrew device of the present type this is achieved by providing a unidirectional latch whose blocking direction is reversible. FIG. 2 shows such a reversible unidirectional latch 22, which cooperates with a part of the reduction gear 11 which is driven by the single-phase synchronous motor with an integral reduction ratio in order to ensure that the rotor of the single-phase synchronous motor is always stopped in the position in which it can start correctly. In FIG. 2 the reduction gear 11 comprises the pinion 12 which cooperates with the gear wheel 13, the pinion 12 being driven by the single-phase synchronous motor and rotation being imparted to a further stage of the reduction gear 11 by the gear wheel 13. This gear wheel 13 cooperates with the unidirectional latch 22. This unidirectional latch is constructed by providing a radial surface of the gear wheel 13 with radially-spaced concentric curved tracks 46 and 47 which each include a projecting stop portion 48 and 49, respectively, the stop portions being arranged in such a way that one stop portion can become operative in one of the two directions of rotation. The two curved tracks 46 and 47 may be constituted by the side walls of a groove in the radial surface of the gear wheel 13 or by side walls of raised portions on the radial surface of the gear wheel 13. Furthermore, there is provided a spring-loaded arm 51 which is pivotal about a spindle 50, which carries a projection 52 which extends between the two tracks 46 and 47, and which cooperates slidably with one of the two tracks. In the present example the spring load for the arm 51 is provided by a leafspring 53 arranged adjacent the arm, one end 54 of this spring being connected to the arm 51 near the pivotal axis and the other end 55 of this spring bearing against a stationary part of the corkscrew device, in the present case the housing 1. In the present example the arm 51 and the leafspring 53 are constructed as a single plastic part. Since the leafspring 53 functions as an expansion spring it tends to urge the projection 52 on the arm 51 against the curved track 47.

If the gear wheel 13 is driven in a clockwise direction, the stop portion 49 in the track 47 cooperates with the projection 52 on the arm 51, so that further rotation in this direction is impossible, as a result of which the direction of rotation of the single-phase synchronous motor is reversed automatically and the gear wheel 13 is now driven in the counter-clockwise direction. In this direction of rotation the track 47 pushes the projection 52 on the arm 51 forwards until it slides over the stop portion 49, so that this direction of rotation is not blocked. In order to ensure that in the blocked direction of rotation the abutment of the stop portion 49 with the projection 52 is damped, the arm 51 is constructed so as to be axially deflectable to a limited extent, which in the present case is achieved in that the arm 51 includes an oval strip 56 which is formed into the shape of an eight. As can be seen, an arm of this shape is deflectable both in the direction from the projection 52 towards the spindle 50 which constitutes the pivot for the arm 51 and in the opposite direction. It is obvious that such an elastic deflection can also be obtained in another manner, for example by arranging an elastic intermediate portion in the arm 51. These features ensure that the reduction gear is not subjected to excessive shocks when the unidirectional latch becomes operative.

For switching over the unidirectional latch there is provided an actuating member 57, which is constructed as a slide 59 which is movable from a rest position to an operating position against the action of a spring 58. In the rest position of the slide 59 shown in FIG. 2 a free end 60 of this slide faces the end 55 of the leafspring 53. When the slide 59 is moved in the direction indicated by the arrow 61, its end 60 is pressed against and engages the end 55 of the leafspring 53 and thus moves this spring also in the direction indicated by the arrow 61, thereby tensioning the leafspring 53 so that the arm 51 is pivoted clockwise about the spindle 50 until the projection 52 on this arm engages the curved track 46. If the gear wheel 13 is rotated counter-clockwise the stop portion 48 will cooperate with the projection 52, so that the rotation in this direction is blocked and the direction of rotation of the single-phase synchronous motor is reversed again. If the gear wheel 13 is subsequently rotated clockwise, the stop portion 52 is moved by the curved track 46 until it slides over the stop portion 49, as a result of which the single-phase synchronous motor can rotate further in this direction of rotation.

As the slide 59 returns to its rest position the leafspring 53 can relax and also resumes its original position, so that the arm 51 is again pivoted towards the curved track 47 until the projection 52 on this arm again cooperates with this curved track 47 and the clockwise direction is blocked again.

In the present embodiment the actuating member 57 can be actuated manually, for which purpose the portion 62 of the actuating member 57 which projects from the housing 1 is pushed inwards. However, it is found to be very effective if the actuating member 57 can be actuated directly by the switch for switching on and off the single-phase synchronous motor, in which case this switch may be constructed as a three-position tumbler switch, so that if this switch is toggled out of its rest position in one direction the corkscrew spiral is driven in one direction of rotation in which it is screwed into a cork and if the tumbler switch is toggled in the other direction the unidirectional latch is switched over and the corkscrew spiral is driven in the opposite direction of rotation to twist a cork off the corkscrew spiral.

What is claimed is:

1. A corkscrew which comprises a sleeve coaxial with a corkscrew sprial and formed to cooperate with a bottleneck provided with a cork, the corkscrew sprial being capable of being screwed into the cork in one direction of rotation with the cork being drawn from the bottleneck without the direction of rotation being reversed; a self-starting two-pole single-phase synchronous motor with a diametrically magnetized permanent-magnet rotor for driving the corkscrew spiral; a reduction gear positioned between the motor and the corkscrew sprial and driven by the motor, the reduction gear providing a reduction ratio of 60:1 to 100:1 a reversible unidirectional latch for defining the direction of rotation of the motor, said unidirectional latch cooperating with a part of the reduction gear driven by the motor with an integral reduction ratio; a lead-screw connected to the corkscrew spiral and having a pitch opposite to the pitch of the corkscrew spiral, said lead-screw being driven by the reduction gear; a lead-screw nut cooperating with the lead-screw near the reduction gear, the sleeve being arranged on said lead-screw near the corkscrew spiral so as to be retained and to be slidable freely, the facing sides of the lead-screw nut and the sleeve being provided with abutment surfaces cooperating with each other during removal of the cork from the bottleneck when the lead-screw nut moves along the lead-screw; and means to reverse the blocking direction of the unidirectional latch to select one of the two directions of rotation of the motor.

2. A corkscrew according to claim 1, in which the reversible unidirectional latch is formed by providing a radial surface of said reduction gear part with two radially spaced concentric curved tracks each including a projection stop portion, the stop portion in one track being operative in one direction of rotation and the stop portion in the other track being operative in the other direction of rotation; said unidirectional latch including a spring-loaded pivotal arm carrying a projection extending between the two curved tracks and cooperating slidably with one curved track; and an actuating member engageable with said arm for pivoting the same for slidable cooperation with the other curved track.

3. A corkscrew according to claim 2, which includes a leafspring arranged adjacent the pivotal arm and providing the spring load for said arm, one end of said leafspring being connected to the pivotal arm near the pivotal axis of the arm and the other end of said leafspring bearing against a stationary part of the corkscrew, and in which the actuating member is a slide movable between a rest position and an operating position, a free end of said slide facing that end of the leafspring bearing against the stationary part of the corkscrew when the slide is in its rest position, said free end being pressed against said end of the leafspring when the slide is moved to its operating position to cause the pivotal arm to be pivoted.

4. A corkscrew according to claim 3, in which the pivotal arm and the leafspring are constructed as an integral plastic part.

5. A corkscrew according to claim 2, in which the pivotal arm is axially deflectable to a limited extent.

6. A corkscrew according to claim 5, in which the pivotal arm comprises an oval strip formed into the shape of an eight.

7. A corkscrew according to claim 1, in which one of the abutment surfaces is provided with a friction coating.

8. A corkscrew according to claim 7, in which the other abutment surface is profiled.

9. A corkscrew according to claim 1, in which the two abutment surfaces are conical surfaces having an angle of inclination relative to the axis of the corkscrew spiral of the order of 60°.

10. A corkscrew according to claim 1, in which the sleeve is provided with an elastomeric ring for cooperating with the bottleneck.

11. A corkscrew according to claim 1, in which the lead-screw has at least two turns and has a pitch between 6 mm and 10 mm.

12. A corkscrew according to claim 1, which includes a helical spring coaxial with the lead-screw and urging the lead-screw nut towards a stop situated at that end of the lead-screw adjacent the reduction gear.

13. A corkscrew according to claim 1, which includes a separate helical spring arranged between the sleeve and the lead-screw nut and coaxial with the lead-screw for urging the sleeve towards the corkscrew spiral.

14. A corkscrew according to claim 13, in which the sleeve is made of a transparent material.

15. A corkscrew according to claim 1, which includes a disengageable coupling arranged between the corkscrew spiral and the lead-screw to transmit the rotation of the lead-screw to the corkscrew spiral, said coupling disengaging automatically upon removal of the cork from the bottleneck.

16. A corkscrew according to claim 15, in which the corkscrew spiral has a cylindrical shank fitting an axial bore in the lead-screw and urged away from the corkscrew spiral by a further helical spring arranged in said axial bore; and which includes a transverse pin arranged on the shank and urged into a transverse groove of trapezoidal cross-section formed in the end surface of the lead-screw under the influence of said further helical spring to couple the corkscrew spiral to the lead-screw when the corkscrew spiral is screwed into the cork, said transverse pin becoming disengaged from said transverse groove against the action of said further helical spring to uncouple the corkscrew spiral from the lead-screw during removal of the cork from the bottleneck.

* * * * *